US012121959B2

(12) United States Patent
Hirning et al.

(10) Patent No.: US 12,121,959 B2
(45) Date of Patent: Oct. 22, 2024

(54) THREE-PLATE DIE CASTING MOLD HAVING A SPRUE SYSTEM AND IMPROVED SPRUE SEPARATION, AND DIE CASTING METHOD

(71) Applicant: Bayerische Motoren Werke Aktiengesellschaft, Munich (DE)

(72) Inventors: Fritz Hirning, Laichingen (DE); Andre Schaefer, Rottenburg a.d.Laaber (DE); Jean-Marc Segaud, Landshut (DE); Klaus-Peter Tucan, Landshut (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/914,273

(22) PCT Filed: Feb. 22, 2021

(86) PCT No.: PCT/EP2021/054309
§ 371 (c)(1),
(2) Date: Sep. 23, 2022

(87) PCT Pub. No.: WO2021/190847
PCT Pub. Date: Sep. 30, 2021

(65) Prior Publication Data

US 2023/0111366 A1 Apr. 13, 2023

(30) Foreign Application Priority Data

Mar. 24, 2020 (DE) ..... 10 2020 108 022.0

(51) Int. Cl.
*B22D 17/20* (2006.01)
*B22D 17/22* (2006.01)

(52) U.S. Cl.
CPC ..... *B22D 17/2076* (2013.01); *B22D 17/2236* (2013.01); *B22D 17/2272* (2013.01)

(58) Field of Classification Search
CPC .... B22D 17/20; B22D 17/2076; B22D 17/22; B22D 17/2236; B22D 17/2272; B22D 17/229; B22D 17/24
(Continued)

(56) References Cited

U.S. PATENT DOCUMENTS

| | | | |
|---|---|---|---|
| 8,376,026 | B2 | 2/2013 | Zheng et al. |
| 2003/0041995 | A1 | 3/2003 | Nagasaka et al. |
| 2005/0072550 | A1 | 4/2005 | Nagasaka et al. |

FOREIGN PATENT DOCUMENTS

| | | | |
|---|---|---|---|
| CN | 205341869 | U | 6/2016 |
| DE | 37 35 735 | A1 | 5/1989 |

(Continued)

OTHER PUBLICATIONS

PCT/EP2021/054309, International Search Report dated Mar. 31, 2021 (Three (3) pages).

(Continued)

*Primary Examiner* — Kevin P Kerns
(74) *Attorney, Agent, or Firm* — Crowell & Moring LLP

(57) ABSTRACT

A three-plate die casting mold for producing a metal die-cast part by die casting a molten metal includes a first, second, and third mold part, where the third mold part is disposed between the first and second mold parts. Molten metal is feedable to a die cavity through a sprue system where the sprue system has a plurality of feed channels that are disposed in the third mold part and open into the die cavity. The plurality of feed channels have a respective tapering at a die cavity-side end where the respective tapering locally decreases a channel cross section such that a predetermined breaking point is generated during a die casting operation which allows a defined separation of the metal die-cast part from a sprue created in the sprue system when the three-plate die casting mold is being opened.

8 Claims, 2 Drawing Sheets

(58) Field of Classification Search
USPC ..... 164/265, 339, 342, 344, 137
See application file for complete search history.

(56) References Cited

FOREIGN PATENT DOCUMENTS

| | | | |
|---|---|---|---|
| DE | 195 07 995 | A1 | 12/1995 |
| DE | 196 06 806 | A1 | 8/1997 |
| DE | 10 2012 107 363 | A1 | 3/2013 |
| DE | 10 2015 210 403 | A1 | 12/2016 |
| DE | 10 2017 111 021 | A1 | 11/2018 |
| EP | 0 083 788 | A2 | 7/1983 |
| FR | 1 384 198 | A | 1/1965 |
| GB | 2 148 763 | A | 6/1985 |
| JP | 59-107760 | A | 6/1984 |
| JP | 9-323143 | A | 12/1997 |
| WO | WO 2009/106326 | A1 | 9/2009 |

OTHER PUBLICATIONS

German Search Report issued in German application No. 10 2020 108 022.0 dated Sep. 30, 2020, with Statement of Relevancy (Six (6) pages).
Chinese Office Action issued in Chinese application No. 202180018192.7 dated Apr. 11, 2023, with English translation (Twelve (12) pages).
Chinese-language Chinese Office Action issued in Chinese Application No. 202180018192.7 dated Mar. 27, 2024, with English translation (10 pages).

THREE-PLATE DIE CASTING MOLD HAVING A SPRUE SYSTEM AND IMPROVED SPRUE SEPARATION, AND DIE CASTING METHOD

BACKGROUND AND SUMMARY OF THE INVENTION

The invention relates to what is referred to as a three-plate die casting mold for producing at least one metal die-cast part. The invention also relates to a method for producing at least one metal die-cast part by means of a three-plate die casting mold.

As is known, during die casting, liquid molten metal is pressed at high pressure into the die cavity of a die casting mold (casting die), where it then solidifies. After the molten metal has solidified, the die casting mold is opened to remove the die-cast part (if appropriate, also multiple die-cast parts) from the die. In order to be able to open and close the die casting mold, it has at least two mold parts (mold halves), with at least one of these mold parts being movable relative to the other mold part. The opening and closing is effected using a die casting machine, in which the die casting mold is installed.

A die casting mold usually also has a sprue system, formed by feed channels, distribution points and the like, via which the liquid molten metal enters the die cavity or is fed to the die cavity. The molten metal that has solidified in the sprue system is referred to as sprue, which is separated from the actual die-cast part (shaped part) during removal from the die or after removal from the die and disposed of as waste or else recycled.

The prior art also discloses what are referred to as three-plate die casting molds, in respect of which representative reference is made to the patent document DE 10 2012 107 363 A1. Such a three-plate die casting mold has a third mold part in the form of an intermediate plate, as it were, which is movably arranged between a first, typically stationary mold part and a second, movable mold part. Consequently, there are two mold parting planes, it being possible to remove the die-cast part from the die by way of the first mold parting plane and to remove the sprue from the die by way of the second mold parting plane. When the three-plate die casting mold is being opened, the die-cast part can be pulled away from the sprue by the opening movement of the third mold part (intermediate plate), the die-cast part and the sprue being forcibly parted, or the die-cast part being separated from the sprue.

The object of the present invention is to provide a three-plate die casting mold with improved sprue separation.

The three-plate die casting mold according to the invention (also referred to simply as die casting mold below) for producing at least one metal die-cast part by die casting a molten metal comprises a first, a second and a third mold part, wherein the third mold part (intermediate plate) is arranged between the first and the second mold part. The three-plate die casting mold according to the invention further comprises at least one die cavity (in which the die-cast part to be produced is created) and also a sprue system, through which the molten metal is fed or can be fed to the die cavity, wherein the sprue system has multiple, but at least one, feed channels (which can also be referred to as gates or inflows and/or inflow channels) which are arranged in the third mold part or formed in the third mold part and lead or open into the die cavity. Of course, and therefore at this juncture mentioned only for the sake of completeness, there is a respective mold parting plane between the mold parts, in order to be able to open and close the die casting mold for the purpose of removing the die-cast part created in the die cavity and the sprue created in the sprue system from the die, as is known from the prior art.

According to the invention, what is provided is that the feed channels (of the sprue system) in the third mold part that open into the die cavity, in particular all these feed channels, but at least one of these feed channels, have a respective tapering at their die cavity-side ends, that is to say in the region of the opening into the die cavity, which tapering locally decreases or locally narrows the (respective) channel cross section. These taperings or narrowings make it possible to generate or form predetermined breaking points, in particular annular groove-like or annular notch-like predetermined breaking points, during the die casting operation which allow defined separation of the die-cast part created in the mold cavity from the sprue created in the sprue system or from the sprue webs created in the feed channels when the die casting mold is being opened. That is to say, in other words, that as a result of the taperings, predetermined breaking points, in particular annular groove-like or annular notch-like predetermined breaking points, are created at the transitions between the die-cast part and the sprue during the die casting operation, at which predetermined breaking points the die-cast part, without a parting slide or the like, can be separated, in particular torn away, in a defined way from the sprue or from the sprue webs when the die casting mold is being opened.

The die casting mold according to the invention allows controlled separation of the die-cast part from the sprue at predefined points. Both the die-cast part and the separated sprue therefore have a geometrical state which is always the same, thereby simplifying ejection and/or removal from the die. The outlay on casting finishing for the die-cast part is also reduced. In addition, the mechanical loading of the die casting mold is diminished and as a result the wear on the mold is reduced.

The feed channels in the third mold part that open into the die cavity preferably have a conical, preferentially spherical, form, in particular with cross sections that become smaller in the direction of the die cavity, and in addition to this conical formation each have a tapering at their die cavity-side ends, which tapering locally decreases or locally narrows the channel cross section.

The taperings at the die cavity-side ends of the feed channels in the third mold part that open into the die cavity are preferably each formed by a bead or annular bead or the like around the periphery, preferably around the entire periphery, and in particular having a collar-like shape, which bead(s) are arranged in particular in the opening cross sections and locally narrow the respective feed channel in the opening cross section. As a result, an annular groove-like, in particular annular notch-like, predetermined breaking point can be generated or formed at the respective transition between the die-cast part and the sprue or the sprue web.

The first mold part is preferably formed with pins, in particular with conical or at least semi-conical pins, which, when the die casting mold is closed, project (at the rear side or sprue system-side) into the feed channels that are formed in the third mold part and open into the die cavity. These pins are each formed with an undercut contour or with at least one undercut which, when the die casting mold is being opened, retains or withholds the sprue created in the sprue system or the sprue web created in the respective feed channel and favors the separation of the die-cast part from the sprue as a result. These pins may also be referred to as retaining pins.

It is preferably the case that the pins on the first mold part are in the form not only of retaining pins but also ejectors for the sprue and are coupled in particular to an ejection mechanism or the like for this purpose.

The feed channels in the third mold part that open into the die cavity are preferably aligned perpendicularly or at least substantially perpendicularly to the die cavity, that is to say the feed channels open perpendicularly or at least substantially perpendicularly into the die cavity. This relates in particular to a die cavity for producing a thin-walled and areal die-cast part, in the case of which the feed channels are aligned perpendicularly to the areal extent of the die-cast part to be produced.

The method according to the invention for producing at least one metal die-cast part comprises at least the following steps in the following sequence:

- providing a three-plate die casting mold according to the invention, which is installed in particular in a die casting machine;
- closing the die casting mold and performing a die casting operation, wherein liquid molten metal is pressed through the sprue system into the die cavity;
- opening the die casting mold after the molten metal has solidified, wherein the die-cast part created in the die cavity is separated, in particular torn away, from the sprue created in the sprue system in a defined way at the predetermined breaking points generated or created by the taperings;
- if appropriate, removing the die-cast part and the sprue from the die.

During the opening operation, the die casting mold is preferably opened first in the (second) mold parting plane between the third mold part (intermediate plate) and the first, in particular stationary, mold part (nozzle plate), in which the removal of the sprue from the die also takes place. In this respect, the die-cast part may have been separated from the sprue already at the start of the opening operation, that is to say at the start of the opening movement of the third mold part, which is effected in particular together with the second mold part.

The die-cast part to be produced is preferably a vehicle component, in particular a thin-walled light-metal bodywork component, such as for example a longitudinal member element.

The invention will be described in more detail below with reference to the figures on the basis of a particularly preferred best mode. The features disclosed in the figures and/or the features explained below, also taken in isolation from specific combinations of features, may also be general features of the invention and correspondingly refine the invention.

DETAILED DESCRIPTION OF THE DRAWINGS

Figure 1:
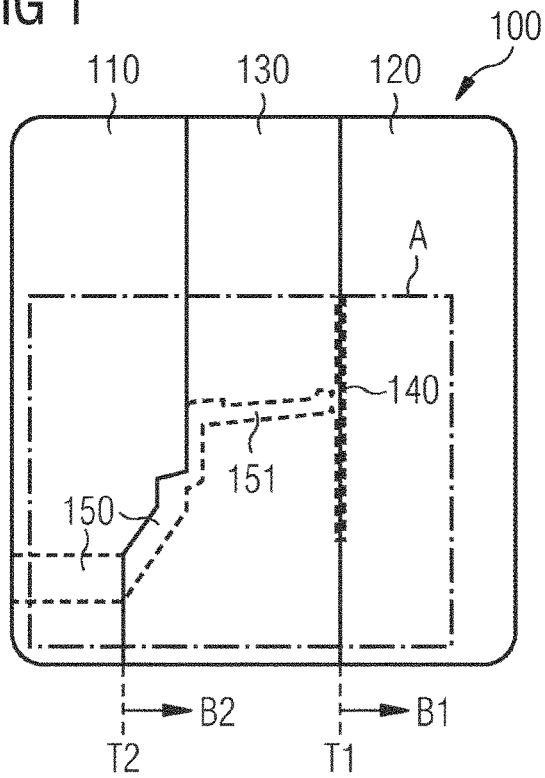
FIG. 1 schematically shows a three-plate die casting mold according to the invention.

The three-plate die casting mold 100 shown in FIG. 1 is installed in a die casting machine, which is not shown, and comprises a first, in particular stationary, mold part 110 (first mold plate), a second, movable mold part 120 (second mold plate) and a third mold part 130 (third mold plate), which is arranged between the first mold part 110 and the second mold part 120 and is likewise movable. The die casting mold 100 further comprises a die cavity 140, for example for producing a thin-walled light-metal bodywork component, and a sprue system 150, through which liquid molten metal enters the die cavity 140. The sprue system 150 may have a similar configuration, for example, to that described in DE 10 2012 107 363 A1.

The three-plate die casting mold 100 advantageously allows a lateral feed, substantially perpendicular with respect to an areal extent of the die-cast part to be produced, of the molten metal to the die cavity 140. For this purpose, the sprue system 150 has multiple conical, and as a result nozzle-shaped, feed channels 151 (also referred to as gates) which are arranged in the third mold part 130 or formed in the third mold part 130 and open into the die cavity 140, in particular substantially perpendicularly.

A first mold parting point or mold parting plane T1 is located between the second mold part 120 and the third mold part 130, and a second mold parting point or mold parting plane T2 is located between the third mold part 130 and the first mold part 110. By moving or displacing the second mold part 120 and the third mold part 130, as illustrated by the arrows B1, B2, the die casting mold 100 can be opened at the mold parting planes T1, T2. It is then possible to remove the die-cast part created in the die cavity 140 by the solidified molten metal from the die by way of the first mold parting plane T1, and to remove the sprue created in the sprue system 150 by the solidified molten metal from the die by way of the second mold parting plane T2. When the three-plate die casting mold 100 is being opened, the die-cast part is forcibly separated from the sprue, as will be explained in more detail below.

Figure 2:
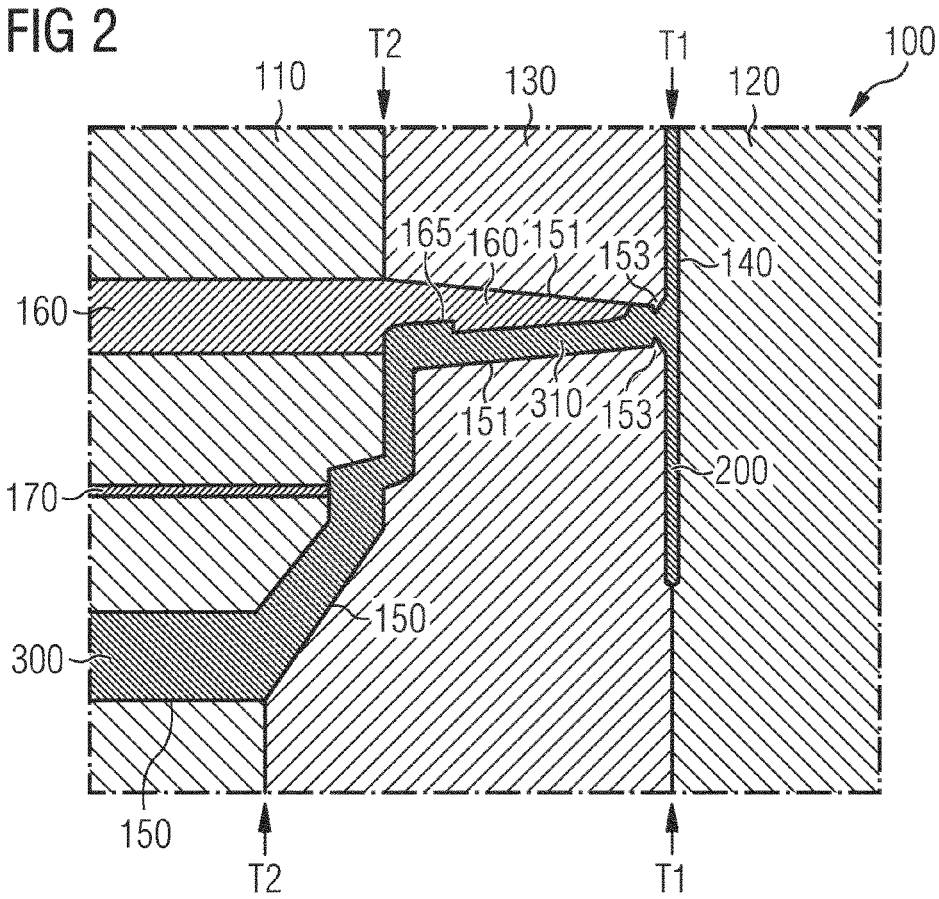
FIGS. 2 to 4 schematically illustrate the mode of operation of the three-plate die casting mold according to the invention on the basis of a detail of the mold, selected by way of example, in accordance with the region A identified in FIG. 1.

FIG. 2 shows the situation after filling the cavity 140 with liquid molten metal by way of the sprue system 150 with the die casting mold 100 closed. The molten metal solidifies in the die cavity 140 to form a die-cast part 200 and in the sprue system 150 to form what is referred to as a sprue 300. A mandrel-like pin 160 (retaining pin), which is arranged on the first mold part 110, is formed with an undercut contour 165, and at its front end preferably likewise has a conical or at least semi-conical shape, is moved into the conical feed channel 151, which opens into the die cavity 140. (The same applies in particular also for the other feed channels or gates in the third mold part 130 that open into the die cavity 140.)

Figure 3:
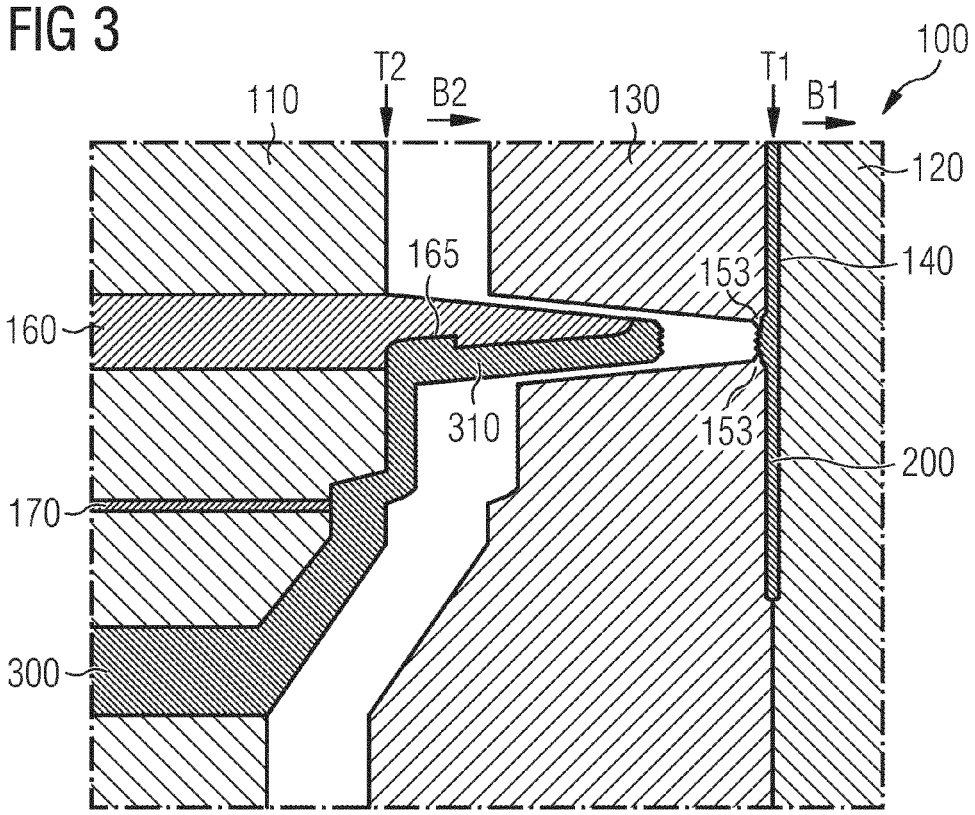

After the molten metal has solidified, the die casting mold 100 is opened in the second mold parting plane T2, as illustrated in FIG. 3. In the process, the die-cast part 200 located in the die cavity 140 is separated from the sprue 300 or from the sprue web 310 by being torn away. According to the invention, at its die cavity-side end, the feed channel 151, formed in the third mold part 130, of the sprue system 150 has a tapering 153 which locally decreases the channel cross section. (The same applies in particular also for the other feed channels in the third mold part 130 that open into the die cavity 140.) The tapering 153 is in the form of a peripheral bead or the like, in particular with a collar-like shape, in the opening cross section 152 to the die cavity 140, as can be seen in particular in FIG. 4.

As a result of the local tapering 153, during the die casting operation an annular groove-like, in particular annular notch-like, predetermined breaking point is generated between the die-cast part 200 and the sprue 300, at which predetermined breaking point a defined separation or tearing away of the die-cast part 200 from the sprue 300 (and specifically directly on the die-cast part 200) takes place already at the start of the opening movement B2 of the third mold part 130, wherein the sprue 300 or the sprue web 310 is retained as a result of a form fit with the undercut contour or with the undercut 165 on the pin 160, thereby favoring separation or tearing away. Only a small, flash-free tear-off point 210 remains on the die-cast part 200.

Figure 4:
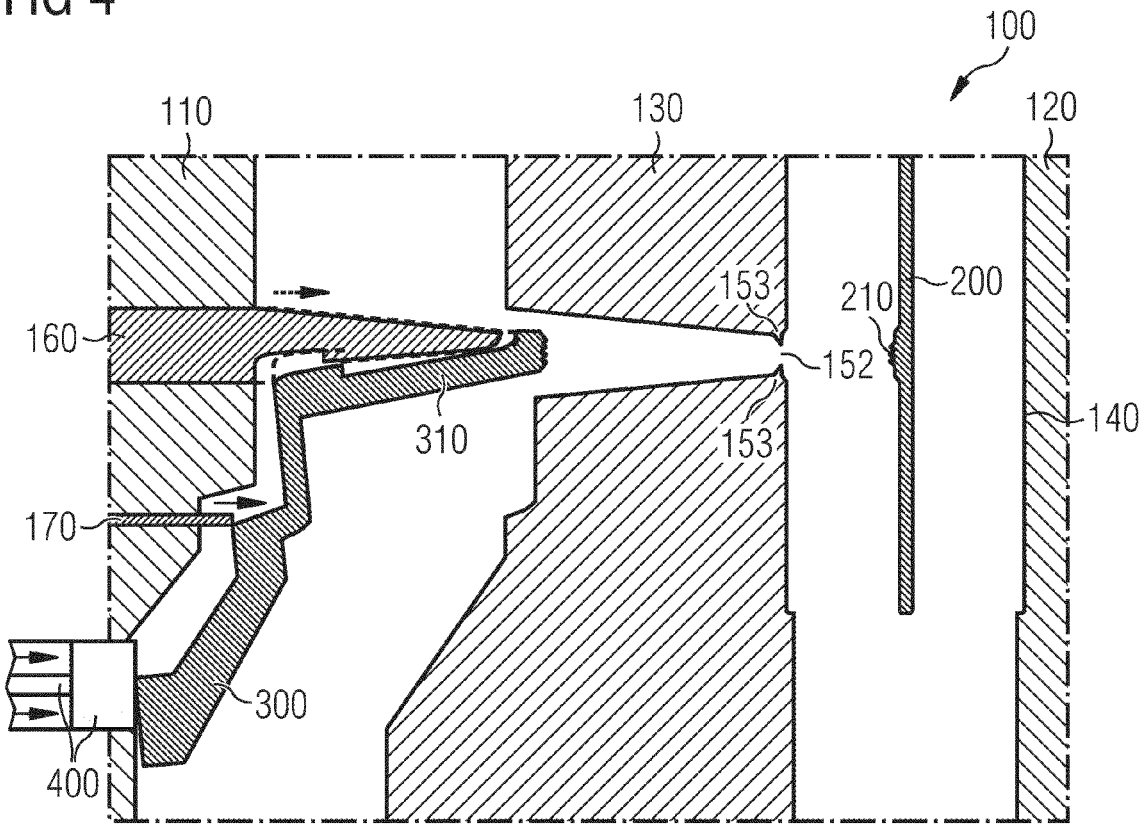

After the die casting mold 100 has been completely opened, as is shown in FIG. 4, the die-cast part 200 and the sprue 300 can be removed from the die. The sprue 300 is removed from the die using at least one ejector 170 in the first mold part 110 and also using the pressure piston 400 which is part of the die casting machine, as is illustrated by the arrows in FIG. 4. The pin or retaining pin 160 may optionally also act as an ejector, as indicated in dashed lines, in order to assist removal from the die. Accordingly, the pin 160 may also be in the form of an ejector. It is similarly possible for ejectors, not shown, to be provided in order to remove the die-cast part 200 from the die.

LIST OF REFERENCE CHARACTERS

100 Three-plate die casting mold
110 First mold part (nozzle plate)
120 Second mold part (closing plate)
130 Third mold part (intermediate plate)
140 Die cavity
150 Sprue system
151 Feed channel
152 Opening cross section
153 Local tapering
160 Pin (mandrel)
165 Undercut contour (undercut)
170 Ejector
200 Die-cast part
210 Tear-off point
300 Sprue
310 Sprue web
400 Casting piston
A Region
B1 Opening movement
B2 Opening movement
T1 First mold parting plane
T2 Second mold parting plane

The invention claimed is:

1. A three-plate die casting mold for producing a metal die-cast part by die casting a molten metal, said die casting mold comprising:

a first mold part;

a second mold part;

a third mold part, wherein the third mold part is disposed between the first mold part and the second mold part;

a die cavity;

a sprue system, wherein the molten metal is feedable to the die cavity through the sprue system and wherein the sprue system has a plurality of feed channels that are disposed in the third mold part and open into the die cavity, wherein the plurality of feed channels in the third mold part that open into the die cavity have a respective tapering at a die cavity-side end, and wherein the respective tapering locally decreases a channel cross section such that a predetermined breaking point is generated during a die casting operation which allows a defined separation of the metal die-cast part from a sprue web created in the sprue system when, during opening of the three-plate die casting mold, the first mold part is separated from the third mold part with the third mold part remaining closed on the second mold part; and a plurality of pins that extend completely through the first mold part and project into respective feed channels in the third mold part when the three-plate die casting mold is closed, wherein the plurality of pins each have a respective conical shape at a front end, and wherein the plurality of pins are each formed with an undercut contour that engages with a respective sprue web formed in the respective feed channel in a form-fit manner and as such retains the respective sprue web adjacent to the first mold part when, during the opening of the three-plate die casting mold, the first mold part is separated from the third mold part with the third mold part remaining closed on the second mold part so as to assist in the defined separation of the metal die-cast part from the respective sprue web.

2. The three-plate die casting mold as claimed in claim 1, wherein the plurality of feed channels each have a conical form.

3. The three-plate die casting mold as claimed in claim 1, wherein the respective tapering is formed by a respective bead around a periphery that is disposed in the channel cross section.

4. The three-plate die casting mold as claimed in claim 1, wherein the plurality of feed channels open perpendicularly into the die cavity.

5. A method for producing a metal die-cast part by the three-plate die casting mold as claimed in claim 1, comprising the steps of:

providing the three-plate die casting mold;

closing the three-plate die casting mold and performing a die casting operation to create the metal die-cast part, wherein a molten metal is pressed through the sprue system into the die cavity;

opening the three-plate die casting mold after the molten metal has solidified, wherein the created metal die-cast part is separated from a sprue web created in the sprue system in a defined way at a respective predetermined breaking point generated by the respective tapering.

6. The method as claimed in claim 5, wherein during the opening, the three-plate die casting mold is opened first in a mold parting plane between the third mold part and the first mold part, wherein the created metal die-cast part has been separated from the sprue web already at a start of the opening.

7. The method as claimed in claim 5, wherein the created metal die-cast part is a vehicle component.

8. The method as claimed in claim 7, wherein the vehicle component is a thin-walled light-metal bodywork component.

* * * * *